US005676067A

United States Patent [19]

Breindel

[11] Patent Number: 5,676,067

[45] Date of Patent: Oct. 14, 1997

[54] MODULAR INTERLOCKING FLAT STORAGE PALLET

[76] Inventor: Alan C. Breindel, 40 Clive Mills Rd., Short Hills, N.J. 07078

[21] Appl. No.: 611,651

[22] Filed: Mar. 6, 1996

[51] Int. Cl.[6] ..... B65D 19/12

[52] U.S. Cl. ..... 108/56.1; 108/180

[58] Field of Search ..... 108/51.1, 54.1, 108/56.1, 51.3, 180, 181, 153; 273/153 R, 156, 160

[56] References Cited

U.S. PATENT DOCUMENTS

| | | | |
|---|---|---|---|
| 3,256,839 | 6/1966 | Peterson et al. | 108/56.1 |
| 3,654,877 | 4/1972 | Barrett . | |
| 3,683,822 | 8/1972 | Roberts et al. | 108/56.3 X |
| 3,878,796 | 4/1975 | Morrison . | |
| 4,576,353 | 3/1986 | Valeria | 108/153 X |
| 4,709,640 | 12/1987 | Jouanin | 108/181 X |
| 4,869,179 | 9/1989 | Sammons et al. | 108/56.1 |
| 4,898,102 | 2/1990 | Thebeau . | |
| 4,993,330 | 2/1991 | Yen . | |
| 5,067,418 | 11/1991 | Carter . | |
| 5,101,737 | 4/1992 | Gomez . | |
| 5,218,913 | 6/1993 | Winebarger et al. | 108/56.1 X |
| 5,458,069 | 10/1995 | Stolzman | 108/56.3 |
| 5,461,988 | 10/1995 | Cummings et al. | 108/56.1 X |

*Primary Examiner*—Jose V. Chen
*Attorney, Agent, or Firm*—Graham & James LLP

[57] ABSTRACT

A modular interlocking flat pallet comprised of elongated longitudinal and lateral members having respective lateral and end interlocking configurations. The lateral elements have either end extensions or member reception hollows and the longitudinal members have multiple aligned lateral edge co-fitting hollows or lateral edge extensions, for engagement with corresponding two or more of the lateral elements. A flat pallet formed thereby has all its components resting directly on the ground for maximum stability.

12 Claims, 3 Drawing Sheets

MODULAR INTERLOCKING FLAT STORAGE PALLET

FIELD OF THE INVENTION

This invention relates to storage pallets for maintaining objects raised from a ground surface and particularly to modular pallets formed by elongated members.

BACKGROUND OF THE INVENTION

Storage pallets are generally used for storage purposes in maintaining items from coming into direct contact with the ground, for purposes such as to prevent moisture damage, to permit for aeration, etc. Pallets are also used as a platform on which objects are transported by forklifts and for such purpose are generally of one-piece construction and are most commonly found and used in warehouses.

For storage purposes in homes or small commercial establishments, the one piece pallets are both unwieldy and do not provide the flexibility necessary for the most efficient utilization of available space. Accordingly, modular pallets have been developed which are formed of pre-selected numbers of interlocking elements. These are interlocked, as desired, to form pallets of specific size.

Generally such modular pallets are formed with elongated longitudinal members interconnected with lateral members. The lateral members are placed cross-wise on the longitudinal member, and are fitted into cut-outs in the upper surface of the longitudinal members. As a result, a two tiered (different levels of longitudinal and lateral members) pallet is formed with the objects being directly supported on the cross-members. Alternatively, the longitudinal and lateral members are level at the supporting surface but the actual support on the ground is through the longitudinal members.

SUMMARY OF THE INVENTION

It is accordingly an object of the present invention to provide a modular pallet and components therefor, of a flat stable configuration with a single supportive tier.

It is a further object of the present invention to provide, with such modular components, a more flexible construction arrangement for a pallet structure, suitable for home use.

It is still yet another object of the present invention to provide such modular pallet for commercial display purposes.

These and other objects, features and advantages of the present invention will become more evident from the following discussion and drawings in which:

SHORT DESCRIPTION OF THE DRAWINGS

FIG. 1, is a top view of a pallet made with the modular components of the present invention, with additional extensions thereof shown in dotted lines;

FIG. 1*a* is an enlarged and separated view of the locking engagement of segment A of FIG. 1;

DETAILED DESCRIPTION OF THE INVENTION

Generally the present invention comprises a modular pallet structure and the components therefor, wherein the pallet is comprised of interlocking longitudinal and lateral members, wherein the longitudinal members have locking engagement means in the lateral edges thereof and the lateral members have locking engagement means at the ends thereof. A lateral member extends from one longitudinal member to another longitudinal member and is interlocked with each, at each end thereof and in the same plane as the longitudinal members. In a preferred embodiment of the present invention each longitudinal member comprises two or more cutouts, most preferably of circular shape for ease in locking fitment. Alternative shapes such as diamonds, triangular wedges or other polygons (i.e., shapes which provide retaining undercuts) provide an advantage in preventing accidental movement or skewing, but must be carefully aligned (particularly with high number polygonal configurations) to avoid non-plumb interconnections.

Each circular (or other shape) cut-out comprises an open section thereof, as part of the lateral edge of the longitudinal member, but such open section must be of a dimension substantially less than the diameter or width of the cut-out. Corresponding to the cut-outs, lateral members (of specific or varying lengths) are provided with ends sized to closely fit into the cutouts. These ends are attached to the bodies of the lateral members by means of reduced size necks having cross sections closely matched to the dimensions of the open sections of the cut-outs. The cut-outs and dimensioned ends are locked together by superimposition and downward fitment. The weight of the objects placed on the formed pallet of interlocked elements prevents unlocking. The residual area of the cut-outs adjacent the neck engagement, prevents lateral disengagement which may otherwise occur, with sliding movement of the objects on the pallet. It is also possible to reverse the arrangement of cut-outs and end extensions, such that the ends of the lateral members are cut out while the lateral edges of the longitudinal members are provided with matching extension members. Ideally the members are molded of high strength plastic for light weight and overall resistance to ground moisture. In addition, the plastic is selected to be dimensionally stable to be able to maintain close interlocking tolerances upon continued use under varying conditions of temperature and weather.

DETAILED DESCRIPTION OF THE DRAWINGS AND THE PREFERRED EMBODIMENTS

Figure 1:
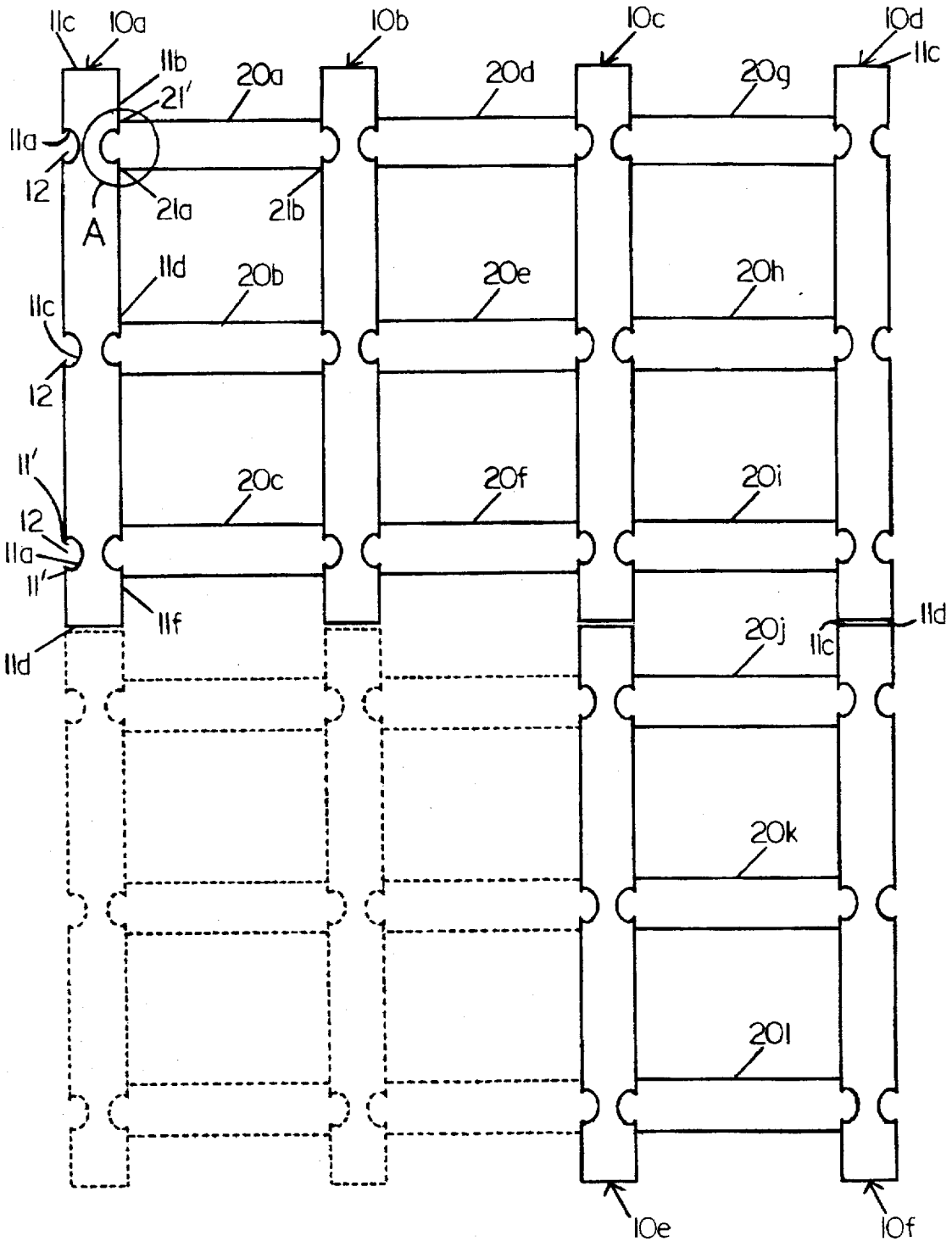
Figure 2:
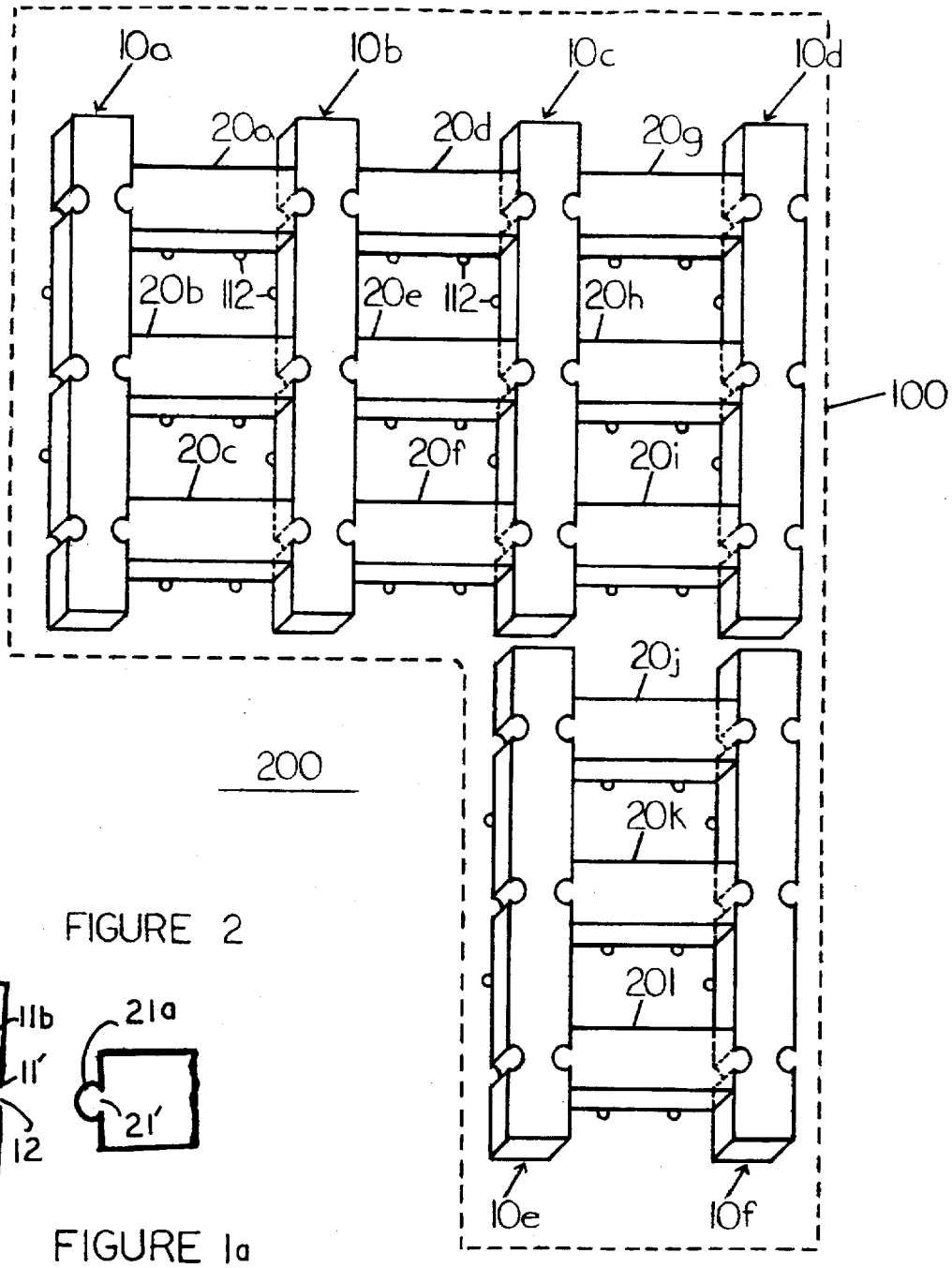
FIG. 2 is a perspective view of the pallet as formed in FIG. 1.
Figure 1A:
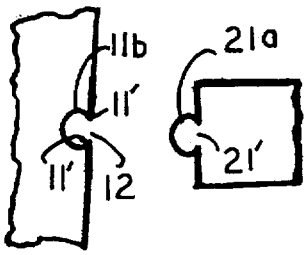

With specific reference to the drawings, in FIGS. 1 and 2, longitudinal members 10*a–f* are shown arranged in a parallel grid pattern to form a pallet or selected size. Each of the longitudinal members, as shown, has six circular cutouts 11*a–f*, with three cutouts on each lateral side. Each of the circular cutouts 11*a–f* has an opening 12. As shown, twelve lateral members 20*a–l*, are used to interlock the six longitudinal members (three lateral or cross members between two longitudinal members). Each of the lateral cross members 20*a–l* includes circle sections 21*a–b* at the ends thereof, with these circle sections adapted to fit into any one of cutouts 11*a–f* from above (or below), with neck sections 21' fitting between portions 11' of the cutouts, adjacent each of the openings 12. The lateral locking engagement between the respective circle sections and cutouts is effected by means of portions 11' of each of the cutouts fitting into neck sections 21' and with portions 11' in turn, effecting an interference fit with the circle sections 21*a–b*. Area A of FIG. 1, as shown in FIG. 1*a*, in expanded and separated form, exemplifies one of the pair of interconnective elements 11*b* and 21*a*.

The dotted lines in FIG. 1 indicate how the pallet can be extended to greater area configurations as required. Though ends of the longitudinal members 11*c* and 11*d* are shown as being simply abutted with ends of members 11*e* and 11*f*, it is possible to provide the longitudinal members with co-fitting end pieces as well (for symmetry, ease in molding, and reduction of the number of parts, each longitudinal member may be made with one end circle and one end cutout) as shown in dotted lines in FIG. 3. Alternatively, cross end locking members 111, with either cutouts or extensions at the ends thereof (depending on the co-fitting shape of the corresponding end of the longitudinal members) may be used to interconnect the adjacent ends of the longitudinal members.

The lengths of the individual longitudinal and lateral members determines the respective longitudinal and lateral sizes of the pallets particularly when small pallets are required. Alternatively, various sizes of both the longitudinal and lateral members may be made available in a pallet construction kit for individualized construction.

Figure 3:
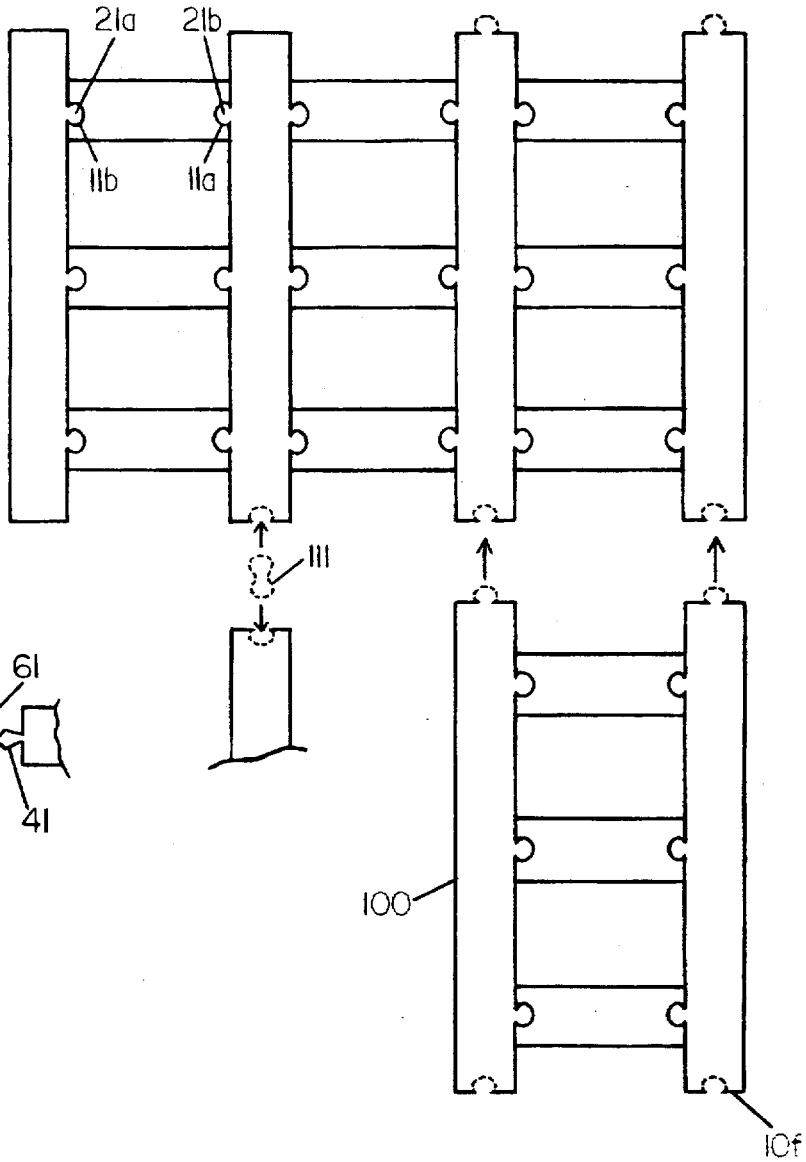
FIG. 3 is a top view of a different embodiment of the pallet structure and components, wherein the interlocking components are reversed.

As shown in FIG. 3, locking interlocking circle elements 21*a–b* and 11*a–f*, are interchanged with opposing placement on longitudinal members 10-*f* and 21*a–l* respectively.

Figure 4A:
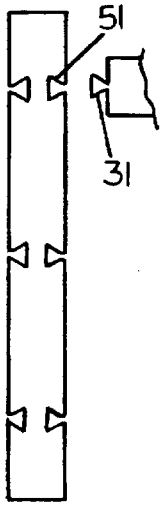
FIGS. 4*a–b* are wedge and diamond variations respectively of the interlocking configurations shown in FIGS. 1, 1*a*, 2 and 3.
Figure 4B:
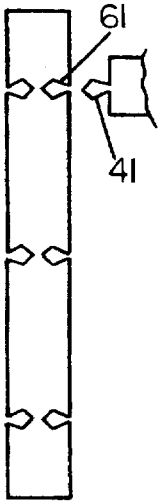

In FIGS. 4*a* and 4*b* wedges 31 and diamonds 41 replace circular sections 11, with corresponding cutouts 51 and 61.

As is evident from FIG. 2, the longitudinal and lateral members of similar thickness form a flat pallet structure 1, with a single level, supporting surface (shown in dotted line as surface plane 100), wherein all of the longitudinal and lateral members support objects placed thereon and wherein all the members are also in contact with the ground 200. If desired, to prevent water collection in damp areas, the longitudinal and lateral members may be provided with integral lifters 112 shown as small extension bumps, which permits water to flow under the pallet members.

It is understood that the above description and drawings are merely illustrative of the present invention and that changes in structure, overall configuration, interlocking arrangement and shapes and the like are possible without departing from the scope of the present invention, as defined by the following claims.

What is claimed is:

1. A modular pallet structure comprised of interlocking elongated longitudinal and lateral members, wherein the longitudinal members, when placed on a ground support, each have two lateral edges and locking engagement means in the lateral edges thereof, and wherein the lateral members each have two ends with locking engagement means at the terminus of the ends thereof, and wherein the locking engagement means of the longitudinal and lateral members are fittingly engaged with each other, with the lateral members only extending between the locking engagement means of two adjacently positioned and spaced apart longitudinal members, whereby the engaged longitudinal and lateral members form an interlocking pallet structure of a desired size, with said interlocking pallet structure comprising means for resisting lateral movement between interlocked longitudinal and lateral members, and wherein each of the interlocked longitudinal and lateral members is vertically supported by the ground support independently from any of the other of the interlocked longitudinal and lateral members.

2. The pallet structure of claim 1, wherein each longitudinal member comprises at least two cutouts in each lateral edge thereof, and wherein each cut-out comprises an open section thereof, as part of the lateral edge of the longitudinal member, wherein each open section is of a dimension less than the width of the cut-out adjacent thereto and wherein the lateral members each comprise ends sized and configured to closely fit into any one of the cutouts.

3. The pallet structure of claim 2 wherein the ends are attached to the lateral members by means of reduced size necks having cross sections closely matched to the dimension of the open section adjacently positioned thereto.

4. The pallet structure of claim 3, wherein the cutouts and ends are matchingly circular.

5. The pallet structure of claim 3, wherein the cutouts and ends are matchingly polygonal and wherein the polygon provides an undercut for lateral retention of the member with the cutout.

6. The pallet structure of claim 3, wherein the longitudinal members each comprise two ends with a cutout in one end and an extension in the other end and wherein said cutouts and extension interfit with each other whereby the longitudinal members are interlockable with each other.

7. The pallet structure of claim 3, wherein the longitudinal members each comprises two ends, with either a cutout or an extension at each end, and wherein the pallet structure further comprises a relatively short interconnective element adapted to be engaged with cutout or extension of adjacent ends of longitudinal members in the pallet structure.

8. The pallet structure of claim 1, wherein each longitudinal member comprises at least two extensions extending from each lateral edge thereof, and wherein the lateral members each comprise ends having cutouts comprising an open section thereof, as part of the end of the lateral member, wherein each open section is of a dimension less than the width of the cut-out adjacent thereto and wherein said cut-outs are sized and configured to closely retain any one of the extensions of the longitudinal members.

9. The pallet structure of claim 8 wherein the extensions are attached to the longitudinal members by means of reduced size necks having cross sections closely matched to the dimension of the open section adjacently positioned thereto.

10. The pallet structure of claim 9, wherein the cutouts and extensions are matchingly circular.

11. The pallet structure of claim 9 wherein the cutouts and extensions are matchingly polygonal and wherein the polygon provides an undercut for lateral retention of the member with the cutout.

12. The pallet structure of claim 1 wherein each of the longitudinal and lateral members further comprises integral lifter extensions which raise all of the longitudinal and lateral members from a ground support for a sufficient distance to thereby permit water to flow under the pallet structure.

* * * * *